US005950479A

United States Patent [19]

Kutschker

[11] Patent Number: 5,950,479

[45] Date of Patent: Sep. 14, 1999

[54] PROCESS AND APPARATUS FOR MOVING SHEET-METAL TO AND FROM A BENDING UNIT

[75] Inventor: Wolfgang Kutschker, Boeblingen, Germany

[73] Assignee: Reinhardt Maschinenbau GmbH, Sindelfingen, Germany

[21] Appl. No.: 09/083,686

[22] Filed: May 22, 1998

Related U.S. Application Data

[63] Continuation of application No. PCT/EP97/04996, Sep. 12, 1997.

[30] Foreign Application Priority Data

Sep. 26, 1996 [DE] Germany ..... 196 39 589

[51] Int. Cl.[6] ..... B21D 5/04; B21D 43/11

[52] U.S. Cl. ..... 72/306; 72/319; 72/405.12; 72/421

[58] Field of Search ..... 72/319–323, 306, 72/421, 405.11, 405.12

[56] References Cited

U.S. PATENT DOCUMENTS

| | | | |
|---|---|---|---|
| 655,903 | 8/1900 | Martin | 72/323 |
| 4,449,390 | 5/1984 | Pontini | 72/405.12 |
| 5,005,394 | 4/1991 | Sartorio | 72/421 |
| 5,042,287 | 8/1991 | Sartorio . | |
| 5,694,801 | 12/1997 | Takahashi | 72/318 |

FOREIGN PATENT DOCUMENTS 43 09 949 9/1994 Germany .

OTHER PUBLICATIONS

Atsushi, Watanabe. *Patent Abstracts of Japan*, Abstract of Japanese Patent No. 5–123766, "Device for Carrying In/Out Plate Material in Bending Apparatus for Plate Material", May 21, 1993, vol. 017, No. 493.

*Primary Examiner*—Daniel C. Crane

*Attorney, Agent, or Firm*—Barry R. Lipsitz; Ralph F. Hoppin

[57] ABSTRACT

In order to optimize a process for the machining of sheet-metal parts in a bending unit of a bending center, in which the sheet-metal parts are transported one after the other from a feed area to the bending unit for the purpose of bending and are thereby taken over by a first manipulator of a manipulator arrangement in a takeover position and then placed against a bending edge for carrying out at least one bending operation, it is suggested that after the last bending operation each finished sheet-metal part be moved away from a bending end position, that during the bending operation of each one of the sheet-metal parts the next respective sheet-metal part be supplied, proceeding from the feed area, to a takeover position arranged so as to be non-overlapping in relation to the bending end position and in this be positioned for gripping by the first manipulator and that the first manipulator begin to take over the next sheet-metal part in the takeover position during the period of time, during which the finished sheet-metal part is leaving the bending end position.

26 Claims, 6 Drawing Sheets

A
10
30
12
38
14

36
18d
20d
32
20a
20c
Y
D
4
4
18a
18c
20b
18b
14
X
52
16
80d
80c
10
82
84
12
34
22
86
3
80a
14
80b
3

PROCESS AND APPARATUS FOR MOVING SHEET-METAL TO AND FROM A BENDING UNIT

This application is a continuation of PCT/EP97/04996, the entire specification of which is incorporated herein by reference.

BACKGROUND OF THE INVENTION

The invention relates to a process for the machining of sheet-metal parts in a bending unit of a bending center, in which the sheet-metal parts are transported one after the other from a feed area to the bending unit for the purpose of bending and are thereby taken over by a first manipulator of a manipulator arrangement in a takeover position and then placed against a bending edge for carrying out at least one bending operation.

With the known process for the machining of sheet-metal parts in a bending center, a respective sheet-metal part is taken over in the feed area, bent in the bending center and finally removed. Subsequent thereto, the next sheet-metal part is then taken over in the feed area and bent as well as subsequently removed.

SUMMARY OF THE INVENTION

The object underlying the invention is to perform the process known so far in a more optimum manner.

This object is accomplished in accordance with the invention, in a process of the type specified at the outset, in that after the last bending operation each finished sheet-metal part is moved away from a bending end position, that during the bending operation of each sheet-metal part the next respective sheet-metal part is supplied, proceeding from the feed area, to a takeover position arranged so as to be non-overlapping in relation to the bending end position and in this is positioned for gripping by the first manipulator and that the first manipulator begins to take over the next sheet-metal part in the takeover position during the period of time, during which the finished sheet-metal part is leaving the bending end position.

The advantage of the inventive process is to be seen in the fact that with it the number of sheet-metal parts machined with a bending center per unit of time can be considerably increased since with the inventive process the time interval required per sheet-metal part for bending can be kept short due to the fact that the first manipulator already takes over the sheet-metal part in a takeover position adjacent to the bending end position and the sheet-metal part can be supplied to the takeover position during the time, during which a bending operation is still taking place with the preceding sheet-metal part so that the time elapsing up to the takeover of the sheet-metal part by the first manipulator no longer influences the number of the sheet-metal parts bent per unit of time.

In principle, the period of time required for the takeover of the next sheet-metal part in the takeover position could be longer than the time which is required to move the finished sheet-metal part out of the bending end position. The inventive solution is particularly favorable when the first manipulator has terminated the takeover of the sheet-metal part when the finished sheet-metal part has left the bending end position since no loss of time whatsoever occurs in the case of the next sheet-metal part.

In order to also proceed as efficiently as possible during the handling of the next part, it is particularly expedient when the first manipulator moves the next sheet-metal part out of the takeover position at the latest after the bending end position is left completely so that the next sheet-metal part is already moved in the direction of the bending unit immediately after the bending end position is left.

In conjunction with the preceding explanations concerning the individual embodiments no details have been given as to the point of time during the bending operation, at which the next sheet-metal part is moved into the takeover position. It would be conceivable, for example, to utilize the entire period of time of several bending operations for this purpose.

Since, however, the first manipulator requires considerable space to turn the sheet-metal part while the successive bending operations are being carried out and thus the takeover position would have to be arranged at such a distance from the bending edge which does not interfere with such turning of the sheet-metal part for the individual bending operations, it is particularly expedient when the sheet-metal part is supplied to the takeover position only during the last bending operation. This solution allows the takeover position to be arranged as close as possible to the bending edge and therefore makes possible, on the one hand, a space-saving construction of the machines and, on the other hand, distances from the takeover position to the bending edge which are as short as possible.

In this case, the sheet-metal part is preferably supplied to the bending end position for removal, following the last bending operation, in this alignment and no longer turned.

With respect to the supply of the sheet-metal part from the takeover position to the bending unit, no details have so far been given. A particularly expedient embodiment provides for the first manipulator to move the respective sheet metal part towards the bending unit such that upon reaching the bending unit a first bending line thereof is placed against the bending edge. This means that the orientation of the sheet-metal part already takes place during its movement out of the takeover position in such a manner that upon reaching the bending unit the first bending line is aligned with the bending edge.

This preferably takes place as a result of the first manipulator displacing the sheet-metal part for this purpose in a plane and rotating it about an axis extending at right angles to this plane.

In this embodiment, it is, for example, possible to position the sheet-metal part in the takeover position irrespective of the position of the first bending line relative to the bending edge and to let the alignment of the two relative to one another be brought about during the course of the movement from the takeover position to the bending edge.

A solution which is particularly space-saving and favorable with regard to movement provides for the sheet-metal part to be moved from the takeover position in a first direction transversely to the bending edge for placement against the bending edge since this solution makes it possible to keep the distance between the takeover position and the bending edge as short as possible.

In this respect, it is also expedient when the sheet-metal part is supplied to the takeover position in a second direction extending transversely to the first direction in order to keep the space required during the handling of the sheet-metal part from the feed area to the bending edge as small as possible.

In this respect, it is particularly favorable when the second direction extends approximately parallel to the bending line.

Since, in the inventive process for the machining of sheet-metal parts, the sheet-metal part is always inserted into the bending unit for carrying out a bending operation and removed again from the bending unit on the same side at least after carrying out the bending operation, the bending end position in the inventive solution is expediently arranged on a side of the bending unit facing the takeover position.

It is particularly favorable when the bending end position and the takeover position are arranged on the same side in front of the bending unit.

In the case of a feed-table, it is preferably provided for the sheet-metal part to be located on the feed table arranged in front of the bending unit in the bending end position and the takeover position and the sheet-metal part to thus, after carrying out all the bending operations, again be handled on the same side of the bending unit, on which the takeover position is also located, proceeding from which the sheet-metal part is taken over by the first manipulator for the bending operations of this sheet-metal part.

With respect to the alignment of the sheet-metal part in the bending end position, no details have so far been given. One advantageous solution, for example, provides for the sheet-metal part to be arranged in the bending end position such that is can be transported past the bending unit in a removal direction without colliding. This solution enables the bending end position, in particular, to be arranged as close as possible to the bending edge in order to keep the distances from the bending edge to the bending end position as small as possible.

This is accomplished in a particularly favorable manner when the sheet-metal part in the bending end position extends with a side edge essentially parallel to the bending edge.

This side edge is preferably the long side edge of the sheet-metal part so that the sheet-metal part extends in the bending end position over as small a distance as possible transversely to the bending edge.

The bending end position and the takeover position are arranged advantageously relative to one another. In order to be able to arrange the bending end position and the takeover position next to one another in as space-saving a manner as possible, it is preferably provided for the sheet metal part in the bending end position to be aligned parallel to the sheet metal part in the takeover position so that the sheet-metal parts in the bending end position and the takeover position can be located next to one another, on the one hand, so as not to overlap and, on the other hand, in as space-saving a manner as possible.

The parallel alignment of the sheet-metal parts in the bending end position and the takeover position merely requires a parallel alignment of the edges thereof relative to one another. For this reason, it is particularly advantageous and space-saving when the sheet-metal parts are aligned identically to one another in the bending end position and the takeover position, i.e. that longitudinal axes thereof extend, for example, parallel to one another.

The most favorable solution provides for the sheet-metal part in the bending end position to be essentially located a directly next to the sheet-metal part in the takeover position, wherein a safety clearance can also be present.

The bending end position and the takeover position could, in principle, be offset relative to one another in the direction of the bending edge. A solution is, however, particularly favorable, in which the sheet-metal part in the bending end position is located at the same level as the sheet-metal part in the takeover position, in relation to the bending edge, and between the sheet-metal part in the takeover position and the bending edge.

With respect to the removal of the sheet-metal part from the bending end position, no details have so far been given. It is particularly expedient, for example, in order to remove the sheet-metal part from the bending end position as quickly as possible, when the sheet-metal part is removed from the bending end position with a removal device separate from the first manipulator.

The removal of the sheet-metal part preferably takes place in a removal direction extending approximately parallel to the bending edge in order to proceed in this case, as well, in as space-saving a manner as possible.

Furthermore, no details have been given in conjunction with the supply of the sheet-metal part to the takeover position. It would, for example, be conceivable to provide a simple conveyor device, with which the sheet-metal part can be supplied from the feed area out of the takeover position. It is, however, particularly favorable when a second manipulator separate from the first manipulator and gripping the sheet-metal part in the feed area is provided for supplying the sheet-metal part to the takeover position. Such a second manipulator has the great advantage that a defined positioning of the sheet-metal part in the takeover position is possible with it in a simple manner.

Furthermore, no details have been given in conjunction with the preceding explanations concerning the different embodiments as to how the sheet-metal part is positioned in a defined manner prior to placement thereof against the bending edge. It would, for example, be possible to move the sheet-metal part with suitable transport devices against respective stop elements and to position the sheet-metal part in a defined manner due to these stop elements. Such a defined positioning of the sheet-metal part by means of stop elements can take place, for example, in the feed area.

The positioning of the sheet-metal part by moving it against stop elements does, however, have the disadvantage that faulty positionings are still possible.

For this reason, a particularly advantageous embodiment provides for the position coordinates of the sheet-metal part relative to the bending edge to be detected and on the basis of the measured position coordinates the sheet-metal part to be moved between the feed area and the bending edge such that the sheet-metal part is supplied to the bending unit for the bending operation in a defined insertion position relative to the bending edge.

The advantage of this solution is to be seen in the fact that as a result of the detection of the position coordinates of the sheet-metal part and correction of the alignment of the sheet-metal part relative to the bending edge during the course of its movement between the feed area and the bending edge faulty positionings can be avoided and, moreover, the placement of the sheet-metal part in the feed area need not take place in a defined manner and thus any oblique position can also be corrected.

The measurement of the position coordinates of the sheet-metal part relative to the bending edge can take place, in principle, during its transport between the feed area and the bending edge.

For reasons of saving time and as rapid a transport of the sheet-metal part as possible from the takeover position to the bending edge it is advantageous when the position coordinates of the sheet-metal part are measured prior to the takeover thereof by the first manipulator so that the work cycles determining the number of sheet-metal parts to be bent per unit of time are not hindered by the detection of the position coordinates.

It would, for example, be conceivable to detect the position coordinates of the sheet-metal part during the movement thereof into the takeover position, wherein the sheet-metal apart could be moved past a measurement means.

It is, however, even more advantageous when the position coordinates of the sheet-metal part are detected prior to any movement thereof into the takeover position since, in this case, the movement of the sheet-metal part into the takeover position also does not experience any hindrance due to the measurement of the position coordinates and thus can take place as quickly as possible, particularly when it is provided for the movement of the sheet-metal part into the takeover position not to take place until during the last bending operation.

A particularly favorable solution provides for the sheet-metal part to be measured in the feed area.

The measurement of the sheet-metal part in the feed area could take place by the sheet-metal part being gripped by the second manipulator and moved past position sensors. It is, however, even more advantageous when the position coordinates of the sheet-metal part are measured prior to the handling thereof by the second manipulator.

The measurement of the position coordinates in the feed area could take place, for example, by means of a separate measuring device. A solution which is particularly favorable with respect to the constructional design provides for the position coordinates of the sheet-metal part to be measured by means of a measuring device moved by the second manipulator.

Furthermore, the inventive object is also accomplished in accordance with the invention, in a bending center comprising a bending unit and a loading device with a feed table for receiving a sheet-metal part to be inserted and a manipulator arrangement, with which the sheet-metal part can be transported from a feed area of the feed table to a bending edge of the bending unit, in that the bending center has a control which operates in accordance with an embodiment of the process described above.

Additional features and advantages of the invention are the subject matter of the following description as well as the drawings illustrating one embodiment.

DETAILED DESCRIPTION OF THE INVENTION

Figure 1:
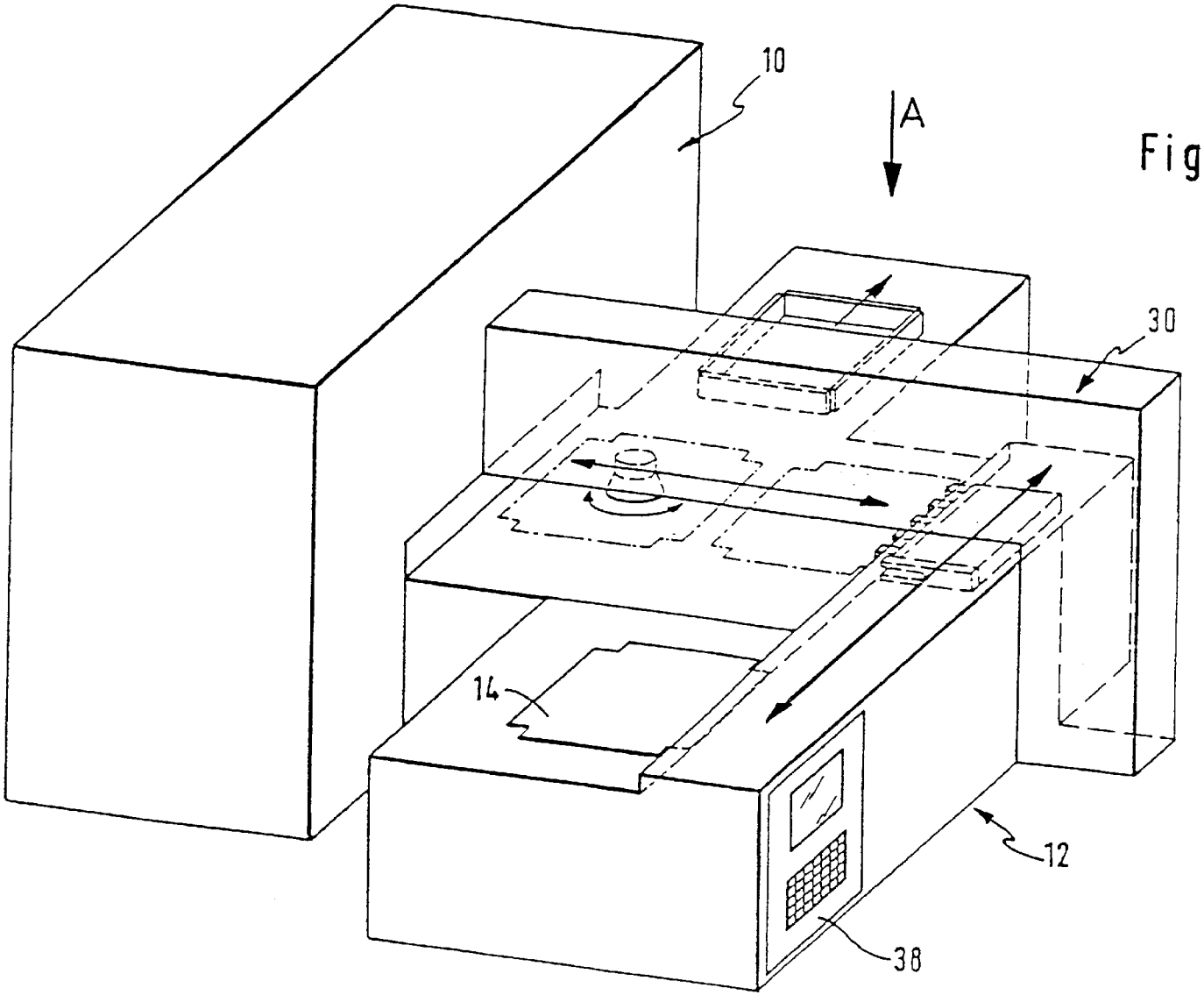
FIG. 1 shows a perspective view of an inventive bending center.
Figure 2:
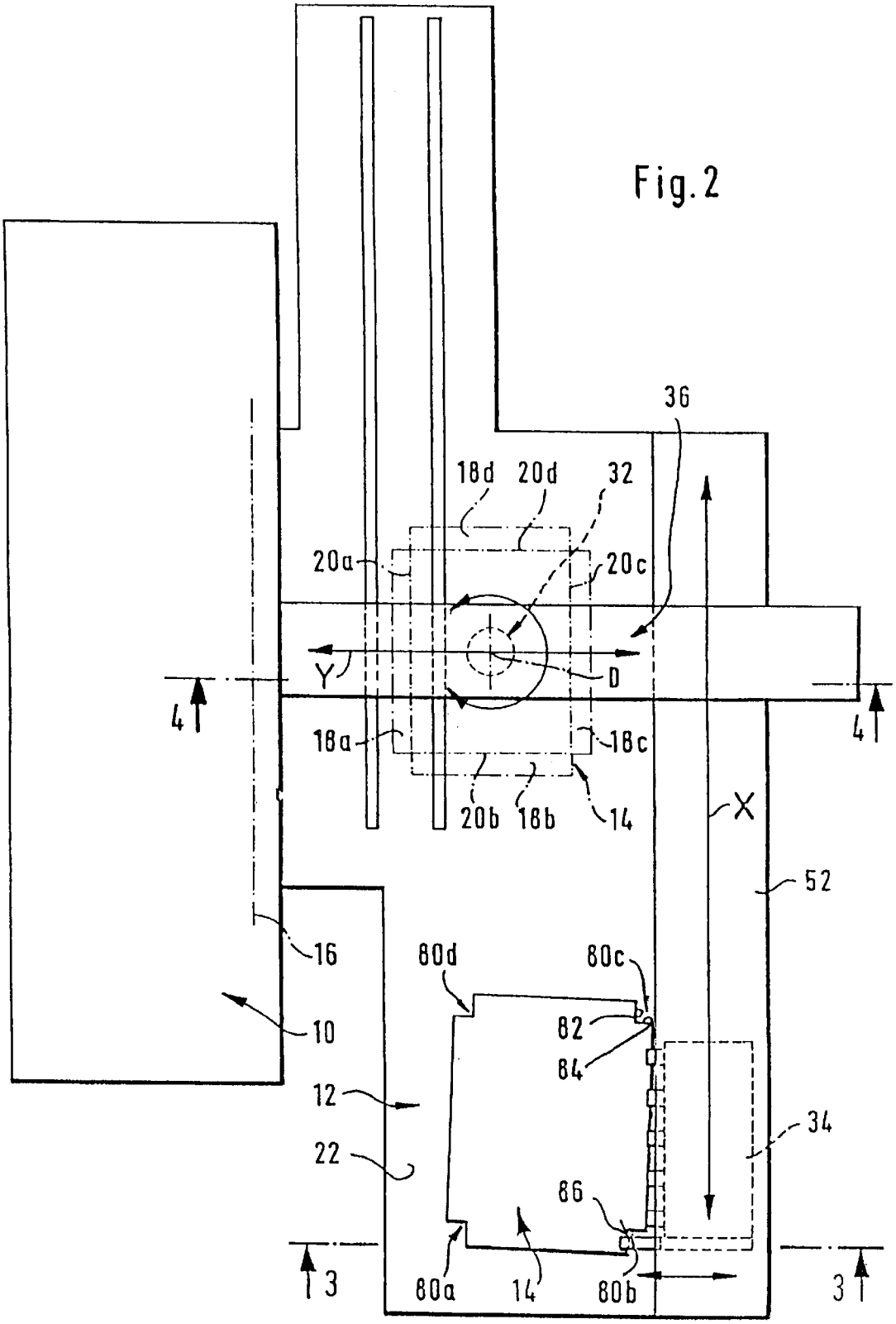
FIG. 2 shows a plan view of the bending center in the direction of arrow A in FIG. 1 during a bending operation with simultaneous measurement of a following sheet-metal part.

An embodiment of an inventive bending center illustrated in FIG. 1 comprises a bending unit designated as a whole as 10 and a loading device which is designated as a whole as 12 and with which a sheet-metal part 14, as is apparent in FIG. 2, can be supplied to the bending unit 10, in particular, a bending device symbolized by the dash-dot bending edge 16 in an insertion position defined in such a manner that, for example, a folding of the edge regions 18*a* to *d* of the sheet-metal part 14 takes place along required bending lines 20*a* to *d* specified by a shape of the sheet-metal part 14. Thus, the insertion position for the sheet-metal part 14 is, for example, defined in such a manner that all the bending lines 20*a* to *d* of the sheet-metal part 14 can be positioned exactly congruent with the bending edge 16 of the bending unit 10.

The inventive loading device 12 comprises for-this purpose a feed table 22, onto which the sheet-metal part 14 can be placed manually or by an additional supply device in a feed area of the feed table 22, wherein a rough positioning of the sheet-metal part 14 in a gripping area of a manipulator arrangement, designated as a whole as 30 and comprising a first manipulator 32 and a second manipulator 34, is adequate.

The second manipulator 34 serves, as illustrated in FIGS. 1 and 2, to transport the sheet-metal part 14 in an X direction away from the feed table 22 into a range of action 36 of the first manipulator 32. The first manipulator 32 transports the sheet-metal part 14, after gripping it, in a Y direction which preferably extends at right angles to the X direction, and rotates the sheet-metal part 14, in addition, about an axis of rotation D which is at right angles to a plane defined by the X direction and the Y direction, wherein the sheet-metal part 14 extends in the plane defined by the X direction and the Y direction.

Both manipulators are thereby controlled by a control which is designated as a whole as 38 and in which the shape of the sheet-metal part 14 and the bending lines 20*a* to 20*d* as well as the coordinates of the bending edge 16 of the bending unit 10 are stored.

Figure 3:
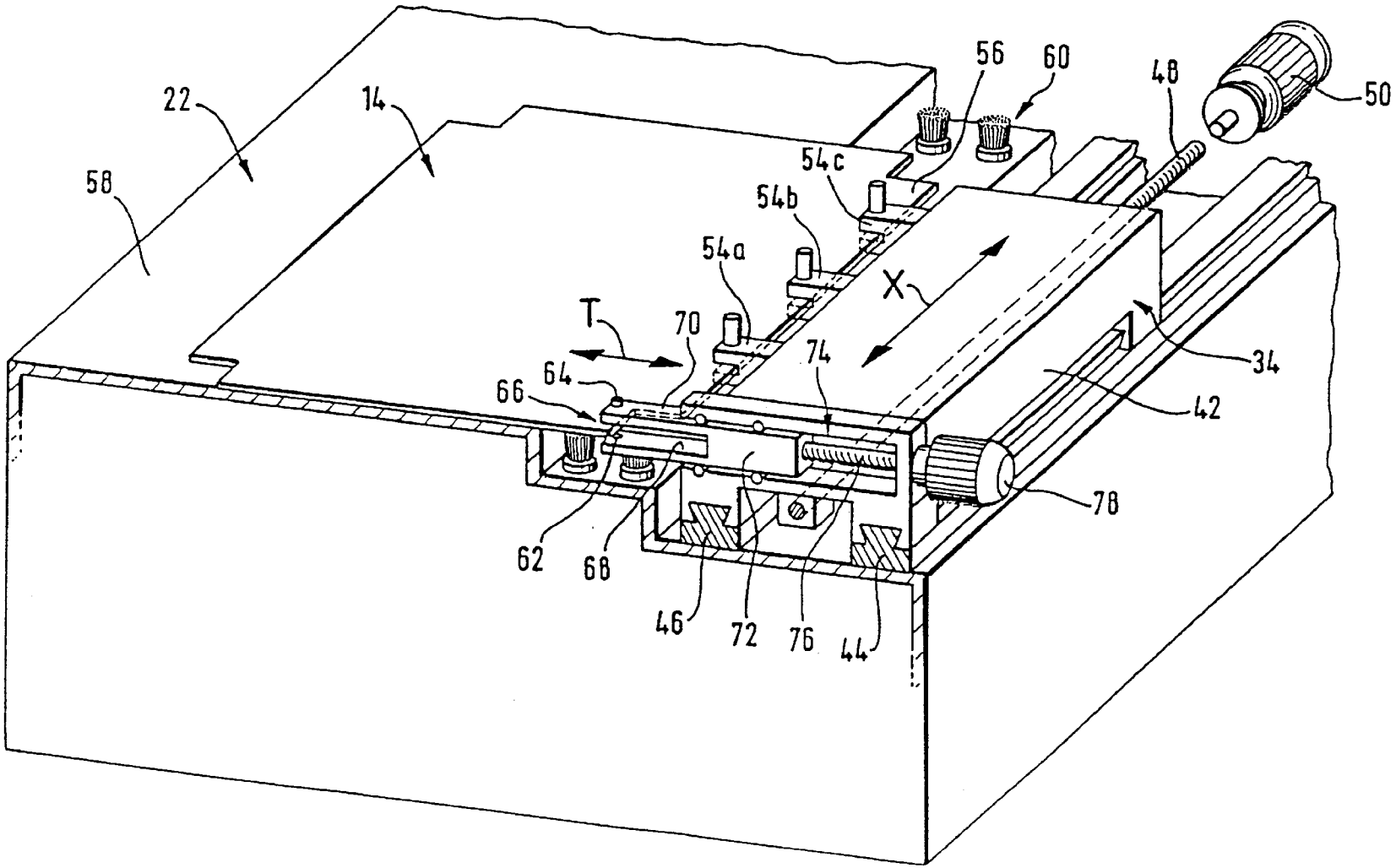
FIG. 3 shows a section along line 3—3 in FIG. 2.

The second manipulator 34 comprises, as illustrated in FIG. 3, a manipulator carriage 42 which is guided on two linear guide means 44 and 46 extending in X direction and parallel to one another and can be positioned along the X direction, for example, by means of a threaded spindle 48, driven by a spindle drive 50, in a numerically controlled manner via the control 38.

The linear guide means 44 and 46 with the manipulator carriage 42 are thereby arranged at a longitudinal side 52 of the loading device 12 and can thus be displaced along the feed table 22.

On its side facing the feed table 22 the manipulator carriage 42 has several gripping tongs 54*a* to *c*, with which the sheet-metal part 14 arranged in the feed area can be gripped in an edge region 56 facing the manipulator carriage 42 and extending approximately along the X direction.

The sheet-metal part 14 is thereby located essentially on a surface 58 of the feed table 22 which does not, however, extend as far as the edge region 56. Rather, the edge region 56 is supported by a field of brushes 60 which allows unhindered access of the gripper tongs 54*a* to *c*.

A sensor 66 which comprises a transmitting element 62 and a receiving element 64 and operates, for example, according to the principle of a light barrier, is held, in addition, at an end of the manipulator carriage 42 of the second manipulator 34 facing away from the range of action 36 of the first manipulator 32 and facing the feed table 22. In this respect, the transmitting element 62 is held on a first finger 68 and the receiving element 64 on a second finger 70 of a forked sensor member which is designated as whole as 72 and is, for its part, held on a linear guide means 74 arranged on the manipulator carriage 42 and can be moved by the linear guide means 74 in a direction T which extends parallel to the Y direction. The positioning of the forked sensor member 72 is brought about via a threaded spindle 76 as well as a spindle drive 78 which is associated with it and likewise makes a numerically controlled positioning of the sensor 66 in the T direction possible, controlled by the control 38.

The forked sensor member 72 is thereby located such that during movement thereof in T direction towards the sheet-metal part 14 the second finger 70 thereof extends over an upper side of the sheet-metal part 14 and the first finger 68 thereof extends under a lower side of the sheet-metal part 14 in order to detect edge positions in the edge region 56 by means of the sensor 66.

As illustrated in FIG. 2, the edge positions are preferably detected in the region of notches 80*b* and 80*c* previously cut into the sheet-metal part 14, wherein an edge 82 extending transversely to the Y direction and an edge 84 extending transversely to the X direction are detected in the notch 80*c* facing the first manipulator 32 and the second manipulator 34 and only the edge 86 extending transversely to the Y direction is detected in the region of the notch 80*b* facing away from the first manipulator 32. An exact detection of the position of the sheet-metal part 14 relative to the later insertion position into the bending unit 10 is possible as a result of the detection of the notches 80*b* and c since the notches 80*a* to d have been cut into the sheet-metal part 14 in a defined arrangement relative to one another and, on the other hand, the notches 80*a* to d also define the bending lines 20*a* to d desired on the sheet-metal part 14 exactly.

The position of the sheet-metal part 14 on the feed table 22 can be determined exactly via the position of the edges 82, 84 and 86 relative to the insertion position and, in particular, to the bending edge 16 of the bending unit 10 and, in particular, the distance in X direction, through which the sheet-metal part 14 must be moved with the second manipulator 34 in the direction of the first manipulator 32 in order to ensure that this grips the sheet-metal part 14 in a position which exactly specifies the relative position of the bending lines 20*b* and 20*d* relative to the axis of rotation D, can be determined exactly for the control 38. The rough positioning of the sheet-metal part 14 on the feed table 22 in the X direction is thus corrected into an exact positioning in relation to the X direction as a result of the transport of the sheet-metal part 14 by means of the second manipulator 34 in the X direction.

Figure 4:
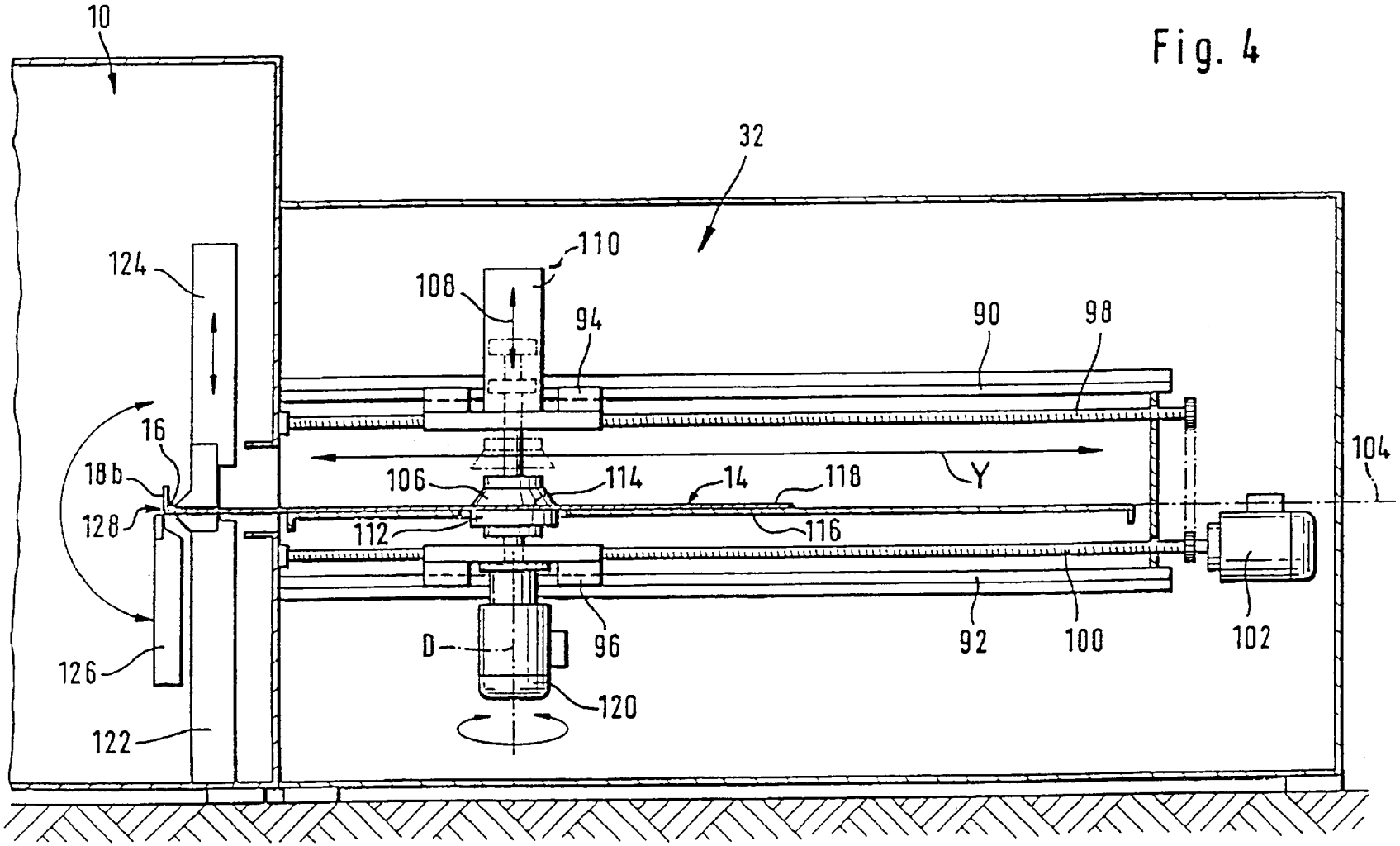
FIG. 4 shows a section along line 4—4 in FIG. 2.

As illustrated in FIG. 4, the first manipulator 32 comprises two linear guide means extending parallel to one another in Y direction, namely an upper linear guide means 90 and a lower linear guide means 92, wherein an upper guide carriage 94 on the upper linear guide means 90 and a lower guide carriage 96 on the lower linear guide means 92 are guided synchronously to one another and located opposite one another. For this purpose, each of the guide carriages can be positioned in Y direction via a threaded spindle 98 and 100, respectively. The two threaded spindles 98 and 100 can be driven via a common spindle drive 102 so that the movement of the guide carriages 94 and 96 in the Y direction likewise takes place in the form of a numerically controlled axis.

The two guide carriages 94 and 96 are arranged on opposite sides of a plane of movement 104 of the sheet-metal part 14 to be handled, wherein for gripping the sheet-metal part 14 a bell-shaped gripper member 106 is arranged on the upper guide carriage 94 and this is movable in a direction 108 at right angles to the plane of movement 104 by means of a cocking cylinder 110. A plate-like gripper member 112 is provided on the lower guide carriage 96 and this extends with a plate-like surface 114 approximately in the plane 104 and is thus in a position to support the sheet-metal part 14 on an underside 116. At the same time, the sheet-metal part can be clamped between the plate-like gripper member 112 and the bell-shaped gripper member 106 by the bell-shaped gripper member 106 being pressed onto an upper side 118 of the sheet-metal part 14 by the cocking cylinder 110.

Narrow rectangular strips can, for example, also be used instead of the bell-shaped gripper member 106 and the plate-like gripper member 112.

Both the plate-like gripper member 112 and the bell-shaped gripper member 106 are mounted on the respective guide carriages 96 and 94 for rotation about the common axis of rotation D, wherein the plate-like gripper member 112 is rotatable by means of a rotary drive 120. The rotary drive 120 can be numerically controlled by the control 38, and the axis of rotation D thus represents a numerically controlled axis of rotation.

As illustrated, in addition, in FIG. 4, the bending unit 10 comprises a customary bending device with a lower beam 122, an upper beam 124 movable relative to this as well as a bending beam 126 which is pivotable about a pivot axis 128 in order to fold, for example, an edge region 18*b* on the sheet-metal part 14 which is located outside the bending lines 20*a* to *d*. In this respect, the bending edge 16 of the bending unit 10 is determined by clamping tools of the lower beam 122 and the upper beam 124.

The sheet-metal part 14 which—as already described—is moved by the second manipulator 34 in X direction into the takeover position 130 for the first manipulator 32 and thereby exactly positioned in X direction in a defined manner and thereby preferably located with its long side parallel to the X direction is gripped by the first manipulator 32 in the takeover position 130, i.e. by means of the plate-like gripper member 112 and the bell-shaped gripper member 106, and firmly clamped. As a result of the numerically controlled movement of the two in Y direction as well as rotation about the axis D, an exact positioning of the sheet-metal part in Y direction relative to the bending edge 16 may be carried out at the same time and a possible twisting of the bending lines 20 provided for the sheet-metal part 14 relative to the bending edge 16 of the bending unit 10 corrected so that the sheet-metal part 14 with the specified bending lines 20 can be positioned exactly at the bending edge 16 of the bending unit 10.

Figure 5:
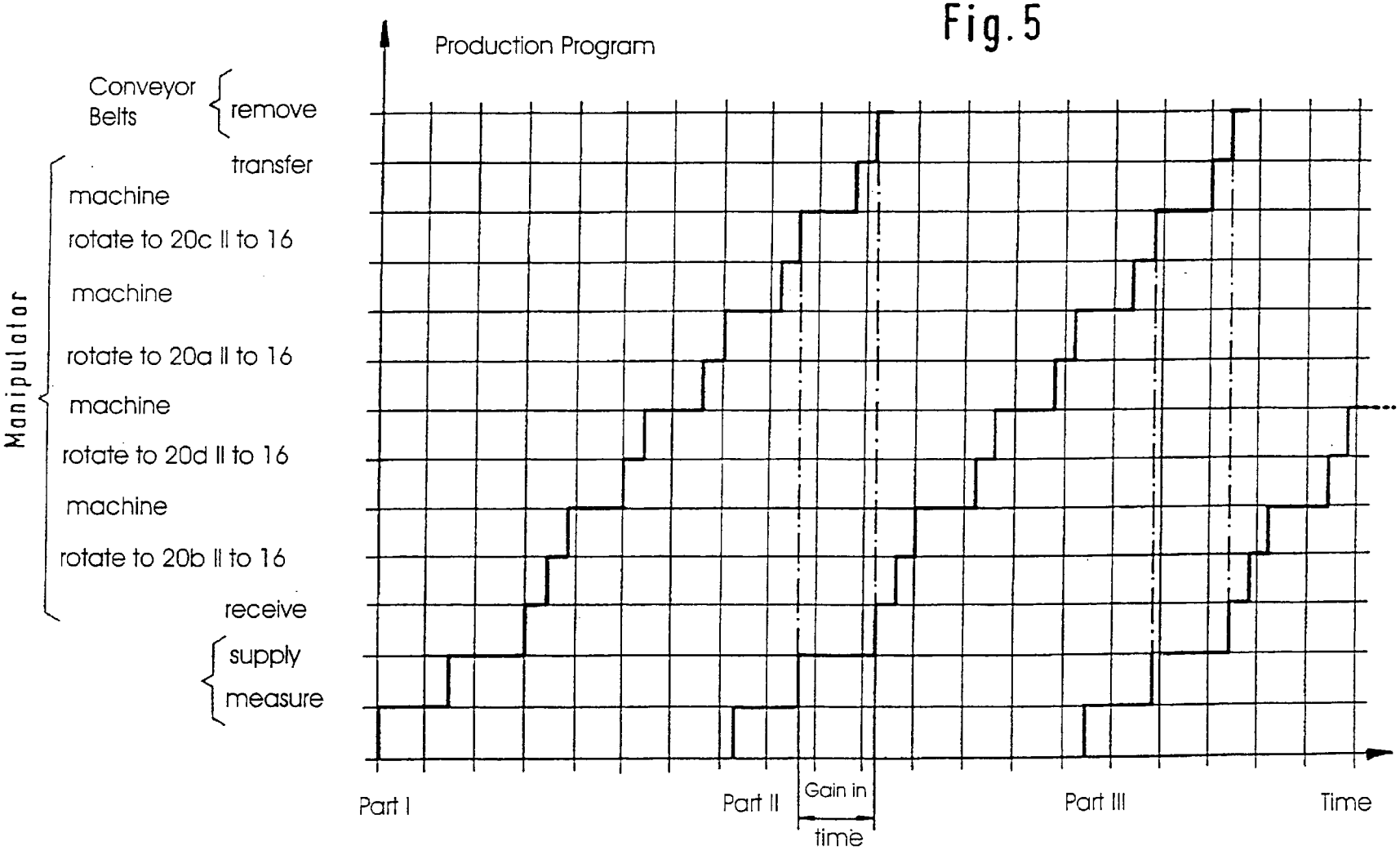
FIG. 5 shows a process diagram for the operation of the embodiment of the bending center and FIG. 6 shows a plan view similar to FIG. 2 with illustration of the takeover position and the bending end position.

As illustrated on the basis of an exemplary production program for part I in FIG. 5, the position coordinates of the sheet-metal part 14 are ascertained on the feed table 22 in a rest position of the sheet-metal part, wherein the position of the edge 84 extending transversely to the X direction already allows the distance to be ascertained exactly, by which the sheet-metal part 14 is to be moved by the second manipulator 34 to a takeover position 130 (FIG. 6) in order to make a takeover by the first manipulator 32 possible in the takeover position 130 with the position of the sheet-metal part 14 corrected in X direction. At the same time, the distances, by which the sheet-metal part 14 is to be moved after takeover by the first manipulator 32 in the direction of the bending unit, are ascertained, on the one hand, by way of the position of the two edges 82 and 86 extending transversely to the Y direction and the extent, to which any twisting of the sheet-metal part 14 in relation to the X direction or the Y direction is present, is ascertained at the same time, wherein this twisting can be corrected by way of rotation about the axis of rotation D when the sheet-metal part 14 is gripped by the first manipulator 32.

Figure 6:
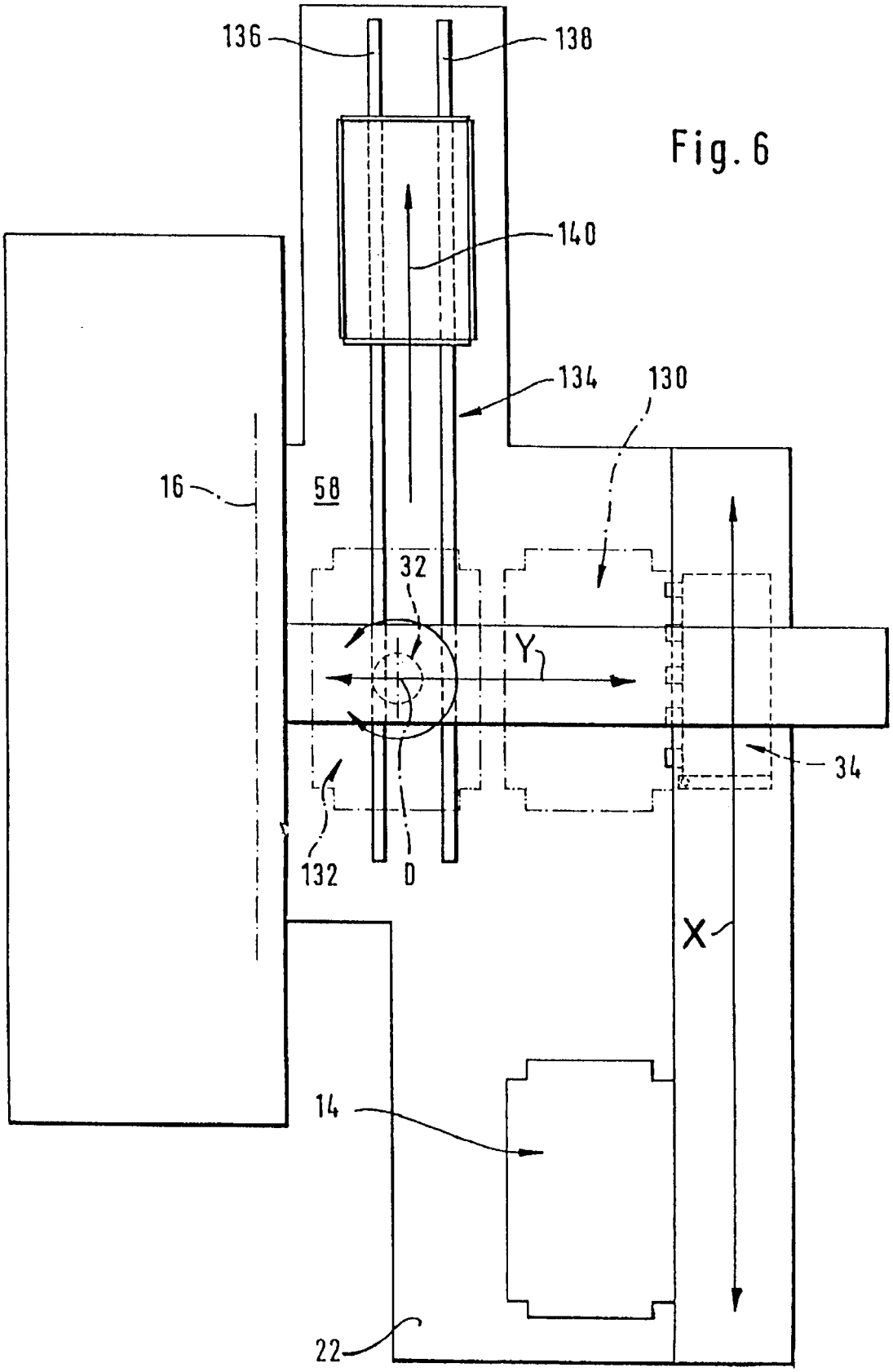

Thus, as illustrated in FIGS. 4 and 6, the bending line 20*b* of a narrow side is first of all to be brought into exact coincidence with the bending edge 16, for example, during the movement of the sheet-metal part 14 from the feed table 22 to the bending unit 10 by means of the manipulators 34 and 32 in order to fold the edge region 18*b* along the bending line 20*b* by way of a first bending process or a first bending operation.

The following movements of the first manipulator 32 consist merely of bringing the bending lines 20*d* of the oppositely located narrow sides and then the bending lines 20*a* and 20*c* of the long sides likewise into coincidence with the bending edge 16 of the bending unit for carrying out the bending operation by rotating the sheet-metal part 14 about the axis D and moving it in Y direction in accordance with the shape thereof entered in the control 38.

During these subsequent bending operations the respective edge region 18*d* or 18*a* or 18*c* is likewise bent over.

After carrying out the last bending operation, i.e. bending up the edge region 18*c*, the finished sheet-metal part 14 is, as illustrated in FIG. 6, transferred into a bending end position 132 which is located close to the bending edge 16 but is removed from this to such an extent that a removal thereof is possible without any problem.

The removal of the sheet-metal part 14 from the bending end position 132 is carried out by means of a removal device 134 which has, for example, two conveyer belts 136 and 138 which are arranged in spaced relation to one another and project beyond a surface 58 of the feed table 22 only when the sheet-metal part is to be accommodated and transported away in a removal direction 140, wherein the removal direction 140 extends parallel to the X direction and, in addition, the long sides of the sheet-metal part 14 likewise extend approximately parallel to the X direction.

Furthermore, the bending end position 132 of the sheet-metal part 14 is located on the feed table 22 such that it does not overlap with the takeover position 130 but a sheet-metal part in the bending end position 132 is arranged at a slight distance in Y direction in relation to a sheet-metal part in takeover position 130.

Such an arrangement of the bending end position 132 and the takeover position 130 makes it possible, as illustrated in FIG. 5 on the basis of part II in relation to part I, for a sheet-metal part 14 placed on the feed table 22 to already be measured and supplied to the takeover position 130, wherein the supply to the takeover position is carried out at a point of time, at which the sheet-metal part 14 designated as part I has been turned such that its bending line 20*c* extends parallel to the bending edge 16 so that the period of time required for bending over the edge region 18*c* can be utilized to position the sheet-metal part 14 in the takeover position 130 by means of the second manipulator 34. This period of time for the positioning of the next sheet-metal part 14 designated as part II in the takeover position 130 can also extend into the period of time which is required in order to move the machined part I which is now finished out of the bending unit 10 after the bending over of the edge region 18*c* and to position it in the bending end position 132.

After the positioning of the sheet-metal part 14 in the bending end position 132, the sheet-metal part 14 is released for removal thereof with the removal device 134 and this period of time is utilized for the purpose of gripping part II with the first manipulator 32 in the takeover position 130 so that—as likewise illustrated in FIG. 5—the first manipulator 32 already moves part II in Y direction immediately when part I has left the bending end position 132, at the same time rotating it about the axis D in order to place the bending line 20*b* of part II against the bending edge 16 as the next step.

Subsequently, the same rotations are then carried out with part II as with part I and as illustrated in FIG. 5.

The advantage of the inventive solution is thus to be seen in the fact that the time interval required for the machining of the sheet-metal part 14 during the last bending operation can already be used for displacing the next sheet-metal part 14 into the takeover position 130.

What is claimed is:

1. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, the first manipulator begins to take over the next respective sheet-metal part in the takeover position during a period of time in which the finished sheet-metal part is leaving the bending end position, and the bending end position is located in front of at least one of the bending unit and the bending edge.

2. A process as defined in claim 1, wherein the first manipulator moves the sheet-metal part out of the takeover position at the latest after the bending end position is left completely by the finished sheet-metal part.

3. A process as defined in claim 1, wherein the first manipulator moves the respective sheet-metal part towards the bending unit such that upon reaching the bending unit a first bending line thereof is placed against the bending edge.

4. A process as defined in claim 3, wherein the first manipulator displaces the sheet-metal part in a plane and rotates it about an axis extending at right angles to this plane.

5. A process as defined in claim 1, wherein the bending end position is arranged on a side of the bending unit facing the takeover position.

6. A process as defined in claim 1, wherein the bending end position and the takeover position are arranged on the same side in front of the bending unit.

7. A process as defined in claim 1, wherein the finished sheet-metal part is arranged in the bending end position such that it is transportable past the bending unit in a removal direction without colliding therewith.

8. A process as defined in claim 1, wherein the sheet-metal part in the bending end position is arranged nearest to the bending edge.

9. A process as defined in claim 7, wherein the sheet-metal part in the bending end position extends with a side edge essentially parallel to the bending edge.

10. A process as defined in claim 9, wherein the sheet metal part in the bending end position extends with a long side edge parallel to the bending edge.

11. A process as defined in claim 1, wherein the sheet-metal part in the bending end position is aligned parallel to the sheet-metal part in the takeover position.

12. A process as defined in claim 11, wherein the sheet-metal part in the bending end position is essentially located directly next to the sheet-metal part in the takeover position.

13. A process as defined in claim 1, wherein a second manipulator separate from the first manipulator and gripping the sheet-metal part in the feed area is provided for supplying the sheet-metal part to the takeover position.

14. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, and the first manipulator begins to take over the next respective sheet-metal part in the takeover position during a period of time in which the finished sheet-metal part is leaving the bending end position, wherein the first manipulator has terminated the takeover of the sheet metal part when the finished sheet-metal part has left the bending end position.

15. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, the first manipulator begins to take over the next respective sheet-metal part in the takeover position during a period of time in which the finished sheet-metal part is leaving the bending end position, and the next respective sheet-metal part is supplied to the takeover position during the bending operation of a last edge region of one of the sheet-metal parts.

16. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, and the first manipulator begins to take over the next respective sheet-metal part in the takeover position during a period of time in which the finished sheet-metal part is leaving the bending end position, wherein:

the sheet-metal part is moved from the takeover position in a first direction transversely to the bending edge for placement against the bending edge, the sheet-metal part is supplied to the takeover position in a second direction extending transversely to the first direction, and the second direction extends approximately parallel to a bending line of the sheet-metal part.

17. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, the first manipulator begins to take over the next respective sheet-metal part in the takeover position during a period of time in which the finished sheet-metal part is leaving the bending end position, and the sheet-metal part is located on the feed area arranged in front of the bending unit in the bending end position and the takeover position.

18. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, the first manipulator begins to take over the next respective sheet-metal part in the takeover position during a period of time in which the finished sheet-metal part is leaving the bending end position, and wherein the sheet-metal part is removed from the bending end position with a removal device separate from the first manipulator.

19. A process as defined in claim 18, wherein the sheet-metal part is removed in a removal direction extending approximately parallel to the bending edge.

20. A process for the machining of sheet-metal parts in a bending unit of a bending center, wherein:

the sheet-metal parts are transported one after the other from a feed area to the bending unit for the purpose of bending and are taken over by a first manipulator of a manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed area, to a takeover position arranged so as to be non-overlapping in relation to the bending end position and positioned for gripping by the first manipulator, the first manipulator begins to take over the next respective sheet-metal part in the takeover position during a period of time in which the finished sheet-metal part is leaving the bending end position, and wherein position coordinates of the sheet-metal part relative to the bending edge are detected and, on the basis of the measured position coordinates, the sheet-metal part is moved between the feed area and the bending edge such that the sheet-metal part is supplied to the bending unit for the bending operation in a defined insertion position relative to the bending edge.

21. A process as defined in claim 20, wherein the position coordinates of the sheet-metal part are measured prior to the takeover thereof by the first manipulator.

22. A process as defined in claim 20, wherein the position coordinates of the sheet-metal part are detected prior to any movement thereof into the takeover position.

23. A process as defined in claim 22, wherein the sheet-metal part is measured in the feed area.

24. A process as defined in claim 21, wherein a second manipulator separate from the first manipulator and gripping the sheet-metal part in the feed area is provided for supplying the sheet-metal part to the takeover position, and the position coordinates of the sheet-metal part are measured prior to the handling thereof by the second manipulator.

25. A process as defined in claim 21, wherein the position coordinates of the sheet-metal part are measured by means of a measuring device moved by the second manipulator.

26. A bending center comprising:

a bending unit, a loading device with a feed table for receiving a sheet-metal part to be inserted into the bending unit, and a manipulator arrangement for transporting the sheet-metal part from a feed area of the feed table to a bending edge of the bending unit, wherein:

sheet-metal parts are transported one after the other from said feed table to the bending unit for the purpose of bending and are taken over by a first manipulator of said manipulator arrangement in a takeover position and then placed against a bending edge for carrying out at least one bending operation, after a final bending operation, each finished sheet-metal part is moved away from a bending end position, during the bending operation of each one of the sheet-metal parts, the next respective sheet-metal part is supplied, proceeding from the feed table, to a takeover position arranged so as to be non-overlapping in relation to the bending end position and positioned for gripping by the first manipulator, the first manipulator begins to take over the next respective sheet-metal part in the takeover position during a period of time in which the finished sheet-metal part is leaving the bending end position, and the next respective sheet-metal part is supplied to the takeover position only during the at least one bending operation at a final edge region.

* * * * *